US010415285B1

(12) United States Patent
Anderson et al.

(10) Patent No.: US 10,415,285 B1
(45) Date of Patent: Sep. 17, 2019

(54) ROTATING HINGE AND SNEEZE GUARD

(71) Applicants: Steven Kirk Anderson, Huntington Beach, CA (US); Steven Kyle Anderson, Lake Forest, CA (US)

(72) Inventors: Steven Kirk Anderson, Huntington Beach, CA (US); Steven Kyle Anderson, Lake Forest, CA (US)

( * ) Notice: Subject to any disclaimer, the term of this patent is extended or adjusted under 35 U.S.C. 154(b) by 0 days.

(21) Appl. No.: 15/985,260

(22) Filed: May 21, 2018

Related U.S. Application Data

(60) Provisional application No. 62/643,896, filed on Mar. 16, 2018.

(51) Int. Cl.

| | |
|---|---|
| ***A47F 10/06*** | (2006.01) |
| ***A47F 9/00*** | (2006.01) |
| ***E05D 11/08*** | (2006.01) |
| ***E05D 1/00*** | (2006.01) |

(52) U.S. Cl.
CPC ..... *E05D 11/08* (2013.01); *A47F 10/06* (2013.01); *E05D 1/00* (2013.01); *A47F 2010/065* (2013.01)

(58) Field of Classification Search
CPC . E05D 11/08; E05D 1/00; A47F 10/06; A47F 2010/065
See application file for complete search history.

(56) References Cited

U.S. PATENT DOCUMENTS 1,358,262 A * 11/1920 Sumner ..... B60J 3/002 296/95.1
4,141,665 A 2/1979 Snapp, Jr.
4,605,227 A 8/1986 Hurd et al.
4,890,950 A * 1/1990 Yoo ..... E06C 1/32 16/328
5,031,606 A 7/1991 Ring, Sr.
5,143,468 A * 9/1992 Pausch ..... F16C 11/10 16/322
5,713,633 A * 2/1998 Lu ..... B60N 2/847 297/364
6,195,839 B1 3/2001 Patterson et al.
6,427,957 B1 * 8/2002 Finneman ..... B60N 3/002 248/185.1
6,481,055 B2 11/2002 Cheng
(Continued)

OTHER PUBLICATIONS www.gasystemsmfg.com/home/products/accessories/sneeze-guards"Sneezeguards-G.A. Systems (accessed Jul. 22, 2018)/-PDF.
(Continued)

*Primary Examiner* — Kimberley S Wright
(74) *Attorney, Agent, or Firm* — Carlos A. Fisher; Stout, Uxa & Buyan, LLP

(57) ABSTRACT

Adjustable hinge assemblies for partially or completely rotating an object joined thereto about an axis in specific, pre-determined increments defined by the interaction of ball pins and detents permit the adjustable hinge to retain an attached object in specific rotational positions until sufficient force is applied in the plane of rotation to overcome this interaction. In certain cases the object may be a door, window, baffle, or airfoil. Preferably, the adjustable hinges may be used as part of a sneeze guard assembly to hold a main sneeze guard pane whose angle can be adjusted to protect food from airborne contamination, such as in airborne saliva or mucus droplets. An optional tuck-away hinge pane prevents contamination of food from the ends of the sneeze guard assembly.

19 Claims, 7 Drawing Sheets

(56) References Cited

U.S. PATENT DOCUMENTS

Figure 1:
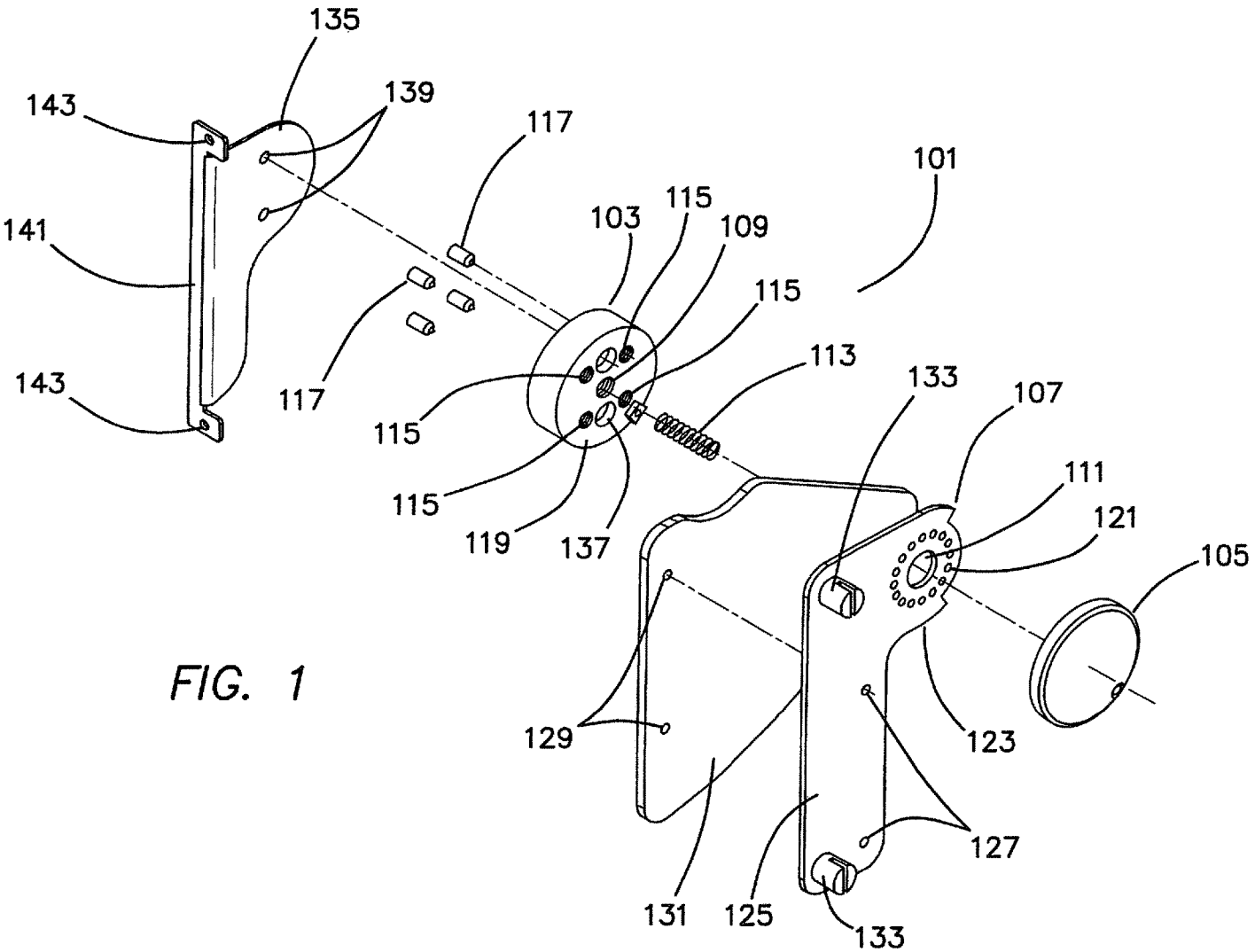

| | | | | |
|---|---|---|---|---|
| 6,588,863 | B1 * | 7/2003 | Yatchak | A47B 3/0803 108/147.11 |
| 6,941,618 | B2 | 9/2005 | Kim | |
| 7,040,723 | B2 * | 5/2006 | Matus, Jr. | A47F 10/06 312/137 |
| 7,440,783 | B2 | 10/2008 | Hyun | |
| 8,186,017 | B2 | 5/2012 | Lin | |
| 8,403,430 | B2 * | 3/2013 | Atkins | A47F 5/005 248/122.1 |
| 8,555,465 | B2 | 10/2013 | Novin | |
| 8,585,160 | B2 * | 11/2013 | Atkins | A47F 5/005 248/122.1 |
| 9,010,883 | B2 * | 4/2015 | Scott | A47F 10/06 312/137 |
| 9,326,621 | B1 * | 5/2016 | McAllister | A47F 10/06 |
| 9,339,131 | B1 * | 5/2016 | Christianson | A47F 10/06 |
| 9,422,757 | B2 | 8/2016 | Bacchetti | |
| 9,538,868 | B1 * | 1/2017 | Christianson | A47F 10/06 |
| 9,723,935 | B1 * | 8/2017 | McAllister | A47F 10/06 |
| 9,782,022 | B2 | 10/2017 | Atkins et al. | |
| 9,801,476 | B2 * | 10/2017 | Maddux | A47F 10/06 |
| 9,839,306 | B2 | 12/2017 | Atkins et al. | |
| 2003/0047086 | A1 * | 3/2003 | Matus, Jr. | A47F 10/06 99/485 |
| 2003/0057810 | A1 * | 3/2003 | DeWitt | A47B 3/0803 312/140 |
| 2005/0136998 | A1 | 6/2005 | Spence et al. | |
| 2007/0236112 | A1 * | 10/2007 | Williman | A47F 3/12 312/140.4 |
| 2008/0155782 | A1 | 7/2008 | Chang et al. | |
| 2010/0045149 | A1 * | 2/2010 | English | A47B 96/062 312/140.4 |
| 2011/0080075 | A1 * | 4/2011 | Matus, Jr. | A47F 3/007 312/140.4 |
| 2011/0169384 | A1 * | 7/2011 | Padden | A47F 10/06 312/140.4 |
| 2012/0200207 | A1 * | 8/2012 | Atkins | A47F 10/06 312/137 |
| 2014/0265757 | A1 * | 9/2014 | Scott | A47F 10/06 312/137 |
| 2015/0208829 | A1 * | 7/2015 | Halprin | A47F 3/0486 62/249 |
| 2016/0331155 | A1 * | 11/2016 | Atkins | A47F 10/06 |

OTHER PUBLICATIONS

Cardinal Patentability Search, "Hinge Sneeze Guard", report dated Mar. 20, 2018.

* cited by examiner

ROTATING HINGE AND SNEEZE GUARD

RELATED APPLICATIONS

This patent application claims priority to provisional patent application Ser. No. 62/643,896, filed Mar. 16, 2018.

FIELD OF THE INVENTION

The invention relates generally to an adjustable hinge component comprising a rotatable arm for rotationally adjusting an item joined to the rotatable arm.

Such items may include, without limitation, at least one transparent pane of a sneeze guard in order to provide a barrier in front of, to the side of, and/or above displayed food and beverage items in various differing food service situations, such as cafeterias. Thus, the invention also relates to equipment or structures containing such an adjustable hinge component, such as, without limitation, a sneeze guard apparatus.

In such a sneeze guard apparatus the adjustable hinge component comprises an adjustment assembly which allows, for example, a transparent main sneeze guard pane, or each of a plurality of transparent main sneeze guard panes in an assembly thereof, to be adjusted angularly or rotationally, and preferably, but not necessarily, independent of one or more other main sneeze guard pane in the assembly.

BACKGROUND OF THE INVENTION

Sneeze guards have been used for many years to protect unpackaged prepared food and beverages, when they are displayed in a service line for customer viewing and selection, from certain contaminants. Indeed, state and local laws and regulations require all such food to be shielded from droplet contamination which may be expelled during a cough or sneeze from the nose or mouth of a potential customer.

Accordingly, sneeze guards are well known and widely used in the food service industry. Sneeze guards are customarily used in retail food service such as cafeterias, smorgasbords, salad bars and buffet lines, which provide a service line displaying food for a customer's selection. Sneeze guards must protect the displayed food in the zone of potential droplet contamination. The zone of potential droplet contamination is determined based upon the height and placement of the service line, and the average height, range of the potential customers.

Although sneeze guards are available in several styles and configurations, typically a sneeze guard has either a rigid support frame, or two or more rigid and stationary support posts, and a mounted pane of glass or plastic material which provides the shield or barrier between the displayed food and the customers. Generally, the rigid support frame or support posts of the sneeze guard are permanently affixed to a stationary surface, such as a service counter or cart. In some preferred sneeze guards, one or both ends of the mounted pane of glass or plastic are abutted with another approximately triangular or sector-shaped and preferably transparent pane or sheet comprising a "wing", which provides a guard against airborne contamination of the displayed food from a person approaching the service food line, serving table, or the like.

Some sneeze guards are designed for use with an attended station in a retail food establishment or an institution. In the attended station, the customer in a service line views the displayed food from the front through a transparent shield or pane, and the selected food is served or handed to the customer by an attendant stationed behind the sneeze guard and service counter. Inc panes of a sneeze guard for use in an attended station service line are generally made so that such panes are completely in front of and over the displayed food or beverages, preventing the items from being handled or touched by the customers.

Sneeze guards are also used for self-service food and beverage lines. In the self-service areas, the customer in a service line also views the displayed food or beverage through a transparent pane, but then reaches under the pane to obtain the selected item. The panes of sneeze guards for use in a self-service area of a service line must be made so that such panes cover the food or beverages from the top and partially cover the displayed food from the front, allowing sufficient space for the customer to reach under the panes to obtain the selected item.

Considering all the potential variables for food service lines, including but not limited to, service counter size and height, size and placement of food containers and dispensers of food/beverage items, and height of customers, a sneeze guard which is not adjustable has severe limitations. It is clear that a non-adjustable sneeze guard must therefore be designed and constructed specifically for each application in order to ensure that the zone of potential droplet contamination is adequately covered. It is also clear that the same sneeze guard unit could not necessarily be used interchangeably for an attended station and for a self-service area service line.

Adjustable sneeze guards are also known. In one type the adjustable sneeze guards may have rigid support posts which may allow the transparent pane to be raised or lowered as appropriate to provide the required zone of protection. Other adjustable sneeze guards have a pivoting mechanism which allows a portion of the support post, or the shield material to pivot, thereby changing the angle of the shield material. For example, U.S. Pat. No. 6,588,863 B1, issued to Yatchak, et al. discloses such an adjustable sneeze guard, whereby the angle of the shield material relative to the post may be adjusted then held in place using a hand-turned screw on the pivoting mechanism, and Atkins et al. U.S. Pat. No. 9,782,022 discloses an adjustment assembly comprising support columns having integral features for coupling an rotational hinge having a detent mechanism separate from other parts of the arm holding the sneeze guard pane.

In practical application, a sneeze guard is rarely a single shield or transparent pane supported by a rigid frame or support posts at either ends of the pane. There is frequently a need in the food service industry to adjust one or more of the panes: for example, to allow some portion of the sneeze guard to be used as an attended station, while other segments are used for self-service (such as selecting packaged beverage items). Further, in some circumstances the height and angle of some, but not all, of the panes may need to be adjusted to accommodate certain serving items, such as large chafing dishes.

Thus there is a need for a simple, elegant and flexible hinged adjustment mechanism that can be easily installed on any appropriate structure or surface, easily, and preferably independently, rotationally adjusted, and held in place without the need for tightening nuts or screws or locking the rotating portion of the hinge.

SUMMARY OF THE INVENTION

The present invention is directed toward addressing this need by providing a novel adjustable hinge assembly component. This adjustable hinge assembly component (adjustable hinge) may be installed and used in a sneeze guard in a manner which allows each of the transparent sneeze guard panes in a series of sneeze guard panes to be adjusted angularly and/or rotationally, within the need to tighten a screw or nut to lock the pane in a particular configuration.

In other uses the adjustable hinge component, with appropriate modifications to the size thereof and to the fastening portion of the rotatable arm, may be used to rotatably hold other objects such as, without limitation, doors, windows, airflow foils, and the like, with detent rotational "lock" positions that require nominally greater force to unlock the rotatable arm and continue rotation than is expected to be normally encountered in the use.

In some examples, the invention is directed to the adjustable hinge or adjustment apparatus, regardless of its intended use, whether in a sneeze guard or another application. In other examples, the invention is directed to an adjustable sneeze guard for use in food service equipment containing such a rotational hinge.

In one example, the present invention is directed to a rotating hinge, preferably (but not necessarily) lacking any rotational stop, permitting rotation of one or more rotatable arm contained therein around an axis defined by a screw or bolt joining a first retaining plate, the rotatable arm, and a second retaining plate. When lacking a rotational stop, the adjustable hinge is free to rotate 360° about this axis. In other examples the hinge may contain a rotational stop restricting the degrees of rotation about this axis to any desired angular range.

The rotatable arm comprises a series of small detent holes arranged circumferentially (or partially ciscumferentially) around a larger axial hole. Preferably, but not necessarily, the series of detent holes are spaced substantially equidistantly from each other, and when the hinge is assembled the detent holes act in concert with a plurality of precisely aligned ball pins affixed to, and projecting from, an inside surface of the first retaining plate of the hinge to provide a series of "locked" angular positions. In a preferred example, each ball pin is threaded to fit into a complementarily tapped ball pin hole in the first plate. Preferably the ball pin holes extend through the first retaining plate, from the outside surface thereof to the inside surface.

The ball pins each comprise an elongated housing, preferably (though not necessarily) cylindrical in shape and containing a compressible spring within, and having ball members retained at a first end thereof such that they are in direct or indirect contact with one end of the compressible spring. The other end of the compressible spring is retained within the elongated housing. Ball pins are generally known, and available for sale from, for example, Grainger industrial Supply, 100 Grainger Pkwy, Lake Forest, Illinios 60045-5202.

In preferred, commercially available, examples, the ball pins are threaded on the outside and may contain a head portion at a second end thereof, wherein the head portion is scored or cast to comprise a "drive", such as, without limitation): a Phillips (cross-shaped) drive, a slatted drive, a hex drive, an Allen drive and the like. Such ball pins can be inserted into threaded ball pin holes from the outside surface of the first retaining plate, and screwed in place so that the balls protrude from the inside surface of the first retaining plate. The height of the ball pins may be aligned, for example, by adjusting their depth with a screwdriver, and using a flat surface to ensure a uniform height.

Each of the first retaining plate and the second retaining plate comprises an axial cavity on an inside surface thereof for receiving a retaining screw or bolt which, when the hinge is assembled, joins the first retaining plate and the second retaining plate, with the rotatable arm sandwiched between the plates.

Preferably, the interior of each of these axial cavities is tapped in a manner complementary to the threads of a single retaining screw. The axial cavity in the inside surface of the second retaining plate is surrounded by a ring-like shoulder having a circumference sized to permit the shoulder to be received by the large axial hole of the rotatable arm in a manner permitting the arm to rotate freely around the shoulder. The shoulder has a height greater than the thickness of the rotatable arm, so that when the shoulder of the second retaining plate makes contact with the inside surface of the first retaining plate, the rotatable arm is free to rotate around the shoulder. Thus, when assembled, the shoulder serves as an axle around which the rotatable arm can rotate.

Those of ordinary skill in the art recognize that the ring-like shoulder may alternatively be located on the first retaining plate or separate parts of the ring-like shoulder may be comprised as part of both plates. Additionally, in less preferred embodiments the axle or shoulder about which the rotatable arm moves may comprise a tube or cylindrical bolt joining the first and second retaining plates and positioned through the axial hole of the rotatable arm. For example, in such alternative embodiments, the single retaining screw and the ring-like shoulder may be replaced with a single bolt which is threaded at each end to fit within the axial cavities of the first and second retaining plate, or the ring-like shoulder may be replaced with a cylindrical tube serving as an axle through which the retaining screw is fastened in place.

In a preferred embodiment, during assembly of the adjustable hinge the rotatable arm is placed on the shoulder of the inside surface of the second plate, a retaining screw is placed through the large axial hole of the rotatable arm, and threaded into the axial cavity on the inner surface of ether the first retaining plate or the second retaining plate. The retaining screw can then be fastened and tightened into the axial cavity of the other retaining plate by rotating one of the retaining plates relative to the other. Preferably, the axial cavities are of identical bore, to receive a retaining screw of constant cross-sectional diameter.

Preferably, once the screw has been inserted within the tapped axial cavity of one or each retaining plates to the desired depth, and once the ball pins in the first retaining plate have been properly aligned and adjusted to the desired height above the inside surface of the first retaining plate to properly engage the detent holes of the rotatable arm, the retaining screw is fixed in place within each axial cavity to prevent tightening or loosening of the hinge during use. For example, the screw may be fixed in place using an appropriate sealant, solder, or, preferably an appropriate cement compatible with the materials used for the hinge; e.g., an epoxy cement such as a Loctite® epoxy cement product manufactured by Henkel Corporation (26235 First Street, Westlake, Ohio 44145).

As indicated above, it is important that the ball pins (and thus the ball pin holes) of the first retaining plate be precisely aligned and sized so that they make contact with the rotatable arm in such a way that the ball of each pin engages and extends at substantially the same depth into one of the plurality of detent holes of the rotatable arm as the balls of each other ball pin. Very preferably, but not necessarily always, ball pins, ball pin holes, and detent holes are aligned so that when one ball pin engages with a detent hole, each of the other ball pins also engage with a detent hole.

The plurality of ball pins of the first retaining plate and the plurality of detent holes of the rotatable arm are respectively aligned and arranged to provide various rotational "stop" positions at which the rotatable arm is held as it is moved with respect to the first retaining plate, wherein the balls of the ball pins engage with the detent holes and the rotatable aria is firmly, but movably, held in place by the ball pins. The springs of the ball bins permit the rotatable arm (or a component affixed thereto) to be rotated between stop positions by hand, thus compressing the balls of the ball pins as the detent holes move to another position. When the rotatable arm is moved sufficiently to permit the ball pins to engage a new set of detent holes, the springs of the ball pins cause the balls to again expand into the detent holes, thereby locking the rotatable arm in a new rotational position.

Very preferably, the diameter of each of the plurality of detent holes is less than the diameter of a great circle of the balls of the ball pins. Also, very preferably the diameter of each of the plurality of detent holes is greater than about ¼, or greater than about ⅓, or greater than about ½, the diameter of a great circle of the balls of the ball pins. Alignment of the ball bins should be undertaken so that all ball pins protrude from the inner surface of the first retaining plate at substantially equal heights. Height adjustment may be fine tuned by trial and error so that the rotatable arm of the assembled hinge may be moved only when a desired about of force (greater than gravity) is applied.

The plurality of ball pins may be any number greater than one, up to the number of detent holes. Preferably, the first retaining plate has at least three, or at least four ball pins, so that the rotatable arm is held firmly by each ball pin at each stop position. Also, preferably the ball pins are arranged in a manner than provide maximum physical stability to the rotatable arm when its detent holes are engaged with the ball pins. Thus, if three ball pins are used, the ball pins are preferably arranged in a triangular pattern on the inside surface of the first retaining plate, and to simultaneously align with and engage with detent holes in the rotatable arm. If four pins are used, the ball pins are preferably arranged in a rectangular pattern on the inside surface of the first retaining plate. If five pins are used, the ball pins are preferably arranged in a pentagonal pattern on the inside surface of the first retaining plate, and so forth. Preferably, in all cases the ball pins all simultaneously align and engage with detent holes in the rotatable arm.

In other examples, the present invention is directed to a food shield (sneeze guard) for food service equipment. Such food shields are used to protect unpackaged prepared food and beverages from bacteria, viruses, and other contaminants when food is displayed in a service line for customer viewing and selection.

Thus, in one example, the invention comprises a pair of support posts, one at each end of the main sneeze glass pane. Each support post has a top portion and a bottom portion and includes features for affixing the support column to a surface at the bottom portion of the support column. In most preferred embodiments the term "support post" refers preferably to vertically extending, parallel portions of a sneeze guard support frame; however, in other embodiments the support posts may not be part of a frame and may, for example, be free-standing support posts. The adjustable food shield is further joined to a pair of adjustable hinges (substantially as described above), with one of the adjustable hinges coupled respectively to each support column.

Preferably, each of the adjustable hinges is mounted at the same height on its respective support column as the other hinge, thus assuring that the main sneeze guard pane is mounted substantially horizontally. The rotatable hinges may be mounted on any suitable support column without any special adaptation of the support column, which therefore is not required to have, and preferably lacks, any such special adaptation such as a cast "pocket" other integral feature specially made to mount the hinge.

Thus, in preferred embodiments the outside surface of the first retaining plate of each adjustable hinge is drilled with a plurality of retaining holes. These retaining holes are each preferably tapped to receive a complementarily threaded support screw. The support screws are used to join the rotatable hinge to a mounting bracket by means of a set of hinge mounting holes matching the location of the retaining holes in the first retaining plate. The mounting bracket also comprises a foot portion by which the mounting bracket may be affixed to a support post or to an intermediate mounting plate. In a preferred embodiment the foot portion of the mounting bracket comprises a plurality of post mounting holes. Such post mounting screws may be used to fasten the mounting foot (and thus the mounting plate) either directly to the support post, or to a strong intermediate mounting plate which itself is firmly affixed to the support post.

The adjustable food shield may comprise a top shelf comprising one or more horizontal pane resting upon and attached to the top ends of the support columns, or to a horizontally extending portion connecting support posts.

The adjustable food shield further comprises at least two rotatable arms, each rotatable arm being coupled respectively to each of at least two rotatable hinges of the present invention in the manner set forth above so that the rotation arms are rotatable about an axis generally parallel with a lengthwise dimension of the adjustable food shield. The adjustable hinges provide detents at a number of angular positions of the rotation arms.

The adjustable food shield preferably comprises at least one main sneeze guard pane fixed to the rotatable arms of two adjustable hinge assemblies. In some embodiments, a top shelf, if present, may include a horizontal pane made of glass and a downwardly-extending pane made of glass, the main portion and the downwardly-angled lip being, for example, bonded together at their common edge or separately affixed to the support frame. In some embodiments, the adjustable hinges may limit the angular travel of the rotation arms and main sneeze guard pane. In other embodiments the adjustable hinges may not limit the angular travel of the rotation arms and main sneeze guard pane.

In some embodiments, the main sneeze guard pane can reach at least a horizontal orientation (about 90° relative to the lines defined by the support posts) under the top shelf, and a vertical orientation near and below the front edge of the top shelf. In some embodiments, the adjustable hinges provide detents for the horizontal orientation of the main sneeze guard pane, the vertical orientation of the main sneeze guard pane, and at least one intermediate orientation of the main sneeze guard pane between the horizontal and vertical orientations.

In some embodiments, the adjustable food shield further comprises at least two retractable ball pins configured to "lock" the rotatable arm of each adjustable hinge at each of the detent positions contained therein. Preferably, each ball pin is positioned to engage a detent hole of the rotating arm of each rotating hinge at each of the detent positions in the rotation of the rotatable arm.

Very preferably, the adjustable sneeze guard assembly further comprises at least one tuck-away wing pane affixed to the rotatable arms of at least two of the rotatable hinges. The wing pane may comprise, for example, a substantially triangular or sector-shaped pane of transparent glass or polymer which may be affixed to the rotatable arm of the adjustable hinge, preferably at an angle substantially perpendicular to the plane of the main sneeze guard pane, so as to form an adjustable "corner" to the sneeze guard assembly comprising the main sneeze guard pane and the wing pane joined to the rotatable arms of the sneeze guard. In this way the width of the wing, which extends outward from the food service equipment supporting the sneeze guard, is automatically adjusted in a plane parallel to the plane of rotation of the rotatable arm at the same time that the angle of the main sneeze guard pane is adjusted in a plane substantially perpendicular to the plane of rotation of the rotatable arm; when the main sneeze guard pane is lowered to a vertical angle with respect to the support posts, the wing pane is "tucked away" on the inward side of the food service equipment. Thus, the food items remain protected on both the front and sides from foreign matter regardless of the angle to which the main sneeze guard pane is adjusted.

The rotatable arm is preferably structured to extend in a direction distal from the adjustable hinge and in a plane coextensive with its own plane of rotation. The tuck-away wing pane may be fastened to this distally extending portion of the rotatable arm by any suitable means. Preferably the distal portion of the rotatable arm has a plurality of bolt holes which are aligned with bolt holes in the wing pane and fastened using screws or bolts along a side (preferably the outward-facing side) of the rotatable arm. The wing pane is made to be short enough that it will not interfere with the rotation of the rotating hinge and the rotatable arm and wing pane are structured to be thin enough that they will clear the support post to which the adjustable hinge is affixed.

The distal portion of the rotatable arm is also fabricated so that it can be firmly affixed to or near an end of the main sneeze guard pane in any suitable manner. In some embodiments the distal end of the rotatable arm comprises a foot component extending at an angle substantially perpendicular to the plane of rotation of the rotatable arm. The foot component comprises one or more fastening components for holding the main sneeze guard pane, such as screw holes, bolt holes and the like.

In a preferred embodiment, a side of the distal portion of the rotatable arm comprises one or more slotted fastening component extending from the plane defined by the surface of the rotatable arm, in a manner resulting in the slot or slots defining a plane substantially perpendicular to the plane of rotation of the rotatable arm. The slot or slots are made to be slightly wider than the thickness of the main sneeze guard pane, and very preferably the slotted fastening component(s) comprise a plurality of screw, rivet or bolt holes aligned to permit the main sneeze guard pane to be securely held against and retained by the rotatable arm. For example, the plurality of screw, rivet or bolt holes may penetrate through the slotted fastening component and be aligned with corresponding holes in the end of the main sneeze guard pane so as to permit the main sneeze guard pane to be bolted or screwed to the slotted fastening component of the rotatable arm. Alternatively, the plurality of screw, rivet or bolt holes may penetrate one side of the slotted fastening component and be tapped so as to permit a screw to tighten against the end of the main sneeze guard pane so as to permit the main sneeze guard pane to be firmly held against the slotted fastening component of the rotatable arm.

In one example, the slotted fastening components may be separately manufactured components of the sneeze guard that are bolted or riveted to the distal end of the rotatable arm in such a manner as to project from the rotatable arms of the sneeze guard's adjustable hinge assembly. However, in other, less preferred embodiments of the invention the fastening components of the rotatable arm may be cast or molded as part of the rotatable arm itself.

In certain embodiments an adjustable sneeze guard assembly may comprise two or more main sneeze guard panes. For example, food service table or other food service equipment may have elongated dimensions compared to a standard model, so as to make manufacture or manipulation of a single elongated pane impractical or unwieldy. In such case, one or more intermediate support post (or intermediate support frame containing such intermediate support posts) may be used. These one or more intermediate support posts, in conjunction with the two end support posts, may be used to support the ends of two or more main sneeze guard panes.

In such examples the intermediate support posts may comprise two adjustable hinges aligned so as to hold the ends of two main sneeze guard panes. Preferably the two adjustable hinges are mounted back-to-back, with each adjustable hinge affixed to either a single mounting bracket, or to its own mounting bracket; the mounting bracket(s) may be fastened either on the central outward portion of the intermediate support post(s), or to opposing sides of a single intermediate support post. Additionally, the planes defined by the rotation of the rotating arms of all of the adjustable hinges are very preferably substantially parallel to each other.

In a preferred embodiment, a sneeze guard assembly having at least one intermediate support post has tuck-away wing panes joined to the adjustable hinges, which are in turn joined to each of the two end support posts. In some embodiments, but not all, each of the paired adjustable hinges mounted to each of the one or more intermediate support posts comprise wing panes attached to the rotatable arms thereof. In other embodiments, the paired adjustable hinges joined to one or more intermediate support post may lack tuck-away wing panes.

The adjustable hinge may be made of any suitably durable material. Preferably the components of the adjustable hinge are made from a metal or a metal alloy such as stainless steel, and are screwed, bolted or riveted together. Features of the adjustable hinge components, support posts or the like are very preferably not formed in a mold. In other, currently less preferred embodiments some or all of the adjustable components made be made from a hydrocarbon-based polymer, a carbon polymer, and the like, or any combination of metals, alloys, and/or such materials, so long as the material(s) are sufficiently durable for their intended purpose.

Thus, in one example, the invention comprises an adjustable hinge apparatus comprising a first retaining plate comprising a tapped axial cavity in an inside surface thereof and a plurality of compressible ball pins. Each ball pin is firmly held and oriented within a tapped hole extending through the outside surface of the first retaining plate to the inside surface of the first retaining plate. The ball member of each ball pin engages with a compressible spring within the ball pin housing to render each ball pin compressible at the end of the housing comprising the ball member.

In this example the first retaining plate is connected to a second retaining plate by a screw or bolt, which functions as an axis of rotation for the rotatable arm, which is sandwiched between the first and second retaining plates. For instance, the inside surfaces of the first and second retaining plate preferably comprises a cavity which is tapped to receive the ends of a common connecting screw, which is placed through an axial hole in the rotatable arm, and then screwed into the axial cavities of the first and second retaining plates.

Preferably, therefore, the second retaining plate, like the first retaining plate, comprises a tapped axial cavity in an inside surface thereof. The second retaining plate also has a raised shoulder circumferentially surrounding the axial cavity. In this example, the raised shoulder comprises an axle around which, when the hinge is in an assembled state, the rotatable arm rotates.

The rotatable arm is therefore sandwiched between the first and second retaining plate members and held in place by the connecting screw, which is introduced through the axial hole in the rotatable arm. The rotatable arm has a proximal portion, near the axial hole, and a distal portion extending away from the axial hole; the distal portion of the rotating arm comprises apparatus structured to be affixed to an item to be adjusted, such as a main sneeze guard pane and/or sneeze guard pane. Additionally, the proximal portion of the rotatable arm comprises a plurality of detent holes circumferentially, or partly circumferentially, disposed around the axial hole. Each such detent hole is sized and spaced so as to engage with a ball pin of the first retaining plate when the ball pin of the first retaining plate and the detent hole of the rotatable arm are rotationally aligned.

When assembled, the adjustable hinge functions to hold the rotatable arm substantially immobile at a "locked" angular position until or unless a sufficiently strong force is applied to the rotatable arm in the direction of rotation. A "sufficiently strong force" is a force equal to or greater than that force required to cause the balls of the ball pins engaging with the detent holes in the rotatable arm held at a locked angular position to retract against the ball pin springs and move the rotatable arm's detent holes out of alignment with the ball pins of the first retaining plate.

When a sufficient strong force is applied to the rotatable arm, the arm moves from a first locked angular position. By "locked position" or "locked angle" is meant a position at which ball pins and detent holes align and are engaged such that a sufficiently strong force is required to disengage them. As the rotatable arm moves, the ball pins of the first retaining plate are dislodged from the detent holes in the arm, and the amount of force required to continue rotation of the arm is greatly reduced until the arm reaches a new rotational angle at which the detent holes align with the ball pins of the first retaining plate. At this new locked rotational angle the ball pins again engage the detent holes and are dislodged only when a sufficiently strong force is again applied to the rotatable arm.

It will be understood that in some embodiments the ball pins may not necessarily engage all of the detent holes at every, or any, locked angle of rotation. Similarly, not all the ball pins are necessarily required to engage detent holes at every, or any, locked angle of rotation. In currently preferred embodiments the first retaining plate comprises four ball pins arranged in a equilateral (square) arrangement such that at any locked position each ball pin engages with a detent hole of the rotatable arm.

The elongated housing of the ball pins preferably have a cylindrical shape, but may have any other suitable shape, such as an elongated polygonal shape, sufficient to contain and hold a spring and ball member.

In another aspect of the invention, a food service table sneeze guard comprises two rigid and stationary support posts, with an adjustable hinge mounted to each post. The support posts and hinges are aligned so that a main sneeze guard pane may be affixed to the rotatable arm of each of the mounted adjustable hinges and held in a substantially horizontal orientation. The term "support posts" refers preferably to vertically extending, parallel portions of a sneeze guard support frame; however, in other embodiments the support posts may not be part of a frame and may, for example, be free-standing support posts.

In preferred embodiments, the support posts of the sneeze guard apparatus comprise vertically extending portions of a sneeze guard support frame structured to be mounted to the top surface of a food service table or other equipment. The support frame may comprise at least two inverted "U"-shaped frame elements installed at either end of the sneeze guard assembly. These elements may be fabricated from metal tubing, such as 1" round stainless steel tubing. Each support frame element is arranged to be oriented and mounted on the front and the rear of the food service table, with a horizontal central span bent to provide a horizontal support at the top thereof.

In this and other preferred embodiments the major adjustable hinge components are also fabricated from stainless steel.

The first retaining plate of the adjustable hinge is directly or indirectly affixed to one of the support posts. Preferably, the support post does not contain an integral molded pocket or other feature or fixture to hold the first retaining plate.

The first retaining plate is structured as described above and joined to the second retaining plate and the rotatable arm to form a hinge, as described above. A main sneeze guard pane is joined near a first end thereof to the rotatable arm by a fastening member (such as a slotted connecting member). The rotatable arm is joined to the second retaining plate and rotatable around the hinge in distinct incremental stops, the position of each increment dictated by alignment of the ball members of the expandable housings of the first retaining plate with the corresponding detent holes of rotatable arm, such that the main sneeze guard pane is movable from a first angle position to a second angle position relative to the stationary support posts.

Generally, the second end of the main sneeze guard pane is joined to the second support post by a second adjustable hinge assembly, as described above. In other examples the second end of the transparent pane may be joined to the second support post by any rotatable hinge assembly, whether it contains detent stops or not.

In another example of the invention the sneeze guard described above comprises a tuck-away wing pane, affixed to the rotatable arm and rotatable with the main sneeze guard pane. The tuck away wing is preferably shaped substantially like a sector of a circle, wherein the plane of the first and additional glass plates are oriented at right angles to each other, so as to form a corner of a sneeze guard. Preferably, the sneeze guard comprises a tuck-away wing associated with a hinge assembly supporting each end of the transparent pane.

EXAMPLES

The following examples are intended to provide additional clarity to specific embodiments and aspects of the invention or inventions, which are not limited thereby. The invention(s) are defined solely by the claims.

FIG. 1 is an exploded view of an adjustable hinge assembly 101 of the present invention. The adjustable hinge assembly comprises a first retaining plate 103, a second retaining plate 105 and a rotatable arm 107. The first retaining plate comprises a tapped axial cavity 109 on its inner surface, as does the second retaining plate (not visible in FIG. 1). The rotatable arm has an axial hole 111 through which retaining screw 113 is introduced when the hinge is assembled. In the embodiment shown in FIG. 1, the retaining screw 113 is threaded at both ends so it may be screwed into the axial cavity of the first and second retaining plate 109. Those of ordinary skill in the art will recognize that in other embodiments the hinge may be designed to have an retaining bolt rather than a threaded screw. In such variations, a nut or similar retaining fixture may be retained in a countersunk recess on the outside face of the first and/or second retaining plate.

In the embodiment shown in FIG. 1 the first retaining plate 103 has four tapped ball pin holes 115 arranged in a rectangular pattern. The tapped ball pin holes 115 penetrate all the way through the first retaining plate 103 from the outer surface (not shown) to the inner surface 119 thereof. The exterior housings of ball pins 117 are threaded to fit ball pin holes 115, and the ball pins may introduced from the outside face of the first retaining plate.

The rotatable arm 107 comprises a proximal portion 123 having a series of detent holes 121 arranged circumferentially around the axial hole 111. A distal portion 125 of the rotatable arm 107 extends away from the axial hole 111.

FIG. 1 shows an embodiment of the adjustable hinge structured to comprise a tuck-away wing 131. A plurality of holes 127 in the distal portion 125 of the rotatable arm 107 are arranged and aligned with a corresponding plurality of holes 129 in the tuck-away wing 131. The tuck-way wing is substantially is preferably transparent and made of glass or a polymer; particularly preferably the tuck-away wing 131 is fabricated from ⅜" thick tempered glass, having polished edges.

The tuck-away wing 131 is affixed to the rotatable arm 107 by any suitable means. In preferred embodiments the wing and the rotatable arm are joined by screws or bolts (see FIG. 3; 155) extending through the holes (127,129) in the rotatable arm and tuck-away wing, respectively.

Preferably, the ball pins 117 have a drive such as a slot or a cross inscribed on the end opposite the end containing the balls (not shown) to permit the height of the ball pins 117 above the inner surface 119 of the first retaining plate 103 to be adjusted so as to suitably engage detent holes 121 of the rotatable arm 107 when the adjustable hinge is assembled.

As shown in FIG. 1, rotatable arm 107 also comprises a pair of slotted pane fastening components 133 structured to hold a main sneeze guard pane. Preferably the main sneeze guard pane is fabricated from glass, such as ⅜" thick tempered glass, having polished edges. The slots of the slotted fastening pane components 133 are slightly wider than the thickness of the main sneeze guard pane; the slotted fastening pane components each comprise a screw, rivet or bolt hole aligned to permit the main sneeze guard pane to be securely held against the rotatable arm when in use, and held in place using retaining screws. The main sneeze pane preferably contains holes that such retaining screws may extend through. The slotted pane fastening components 133 may be held in place on the rotatable arm 107 by rivets, screws or bolts.

The first retaining plate shown on FIG. 1 also comprises a plurality of countersunk retaining holes 137 for bolting the adjustable hinge to a mounting bracket 135. The mounting bracket has a corresponding set of hinge mounting holes 139 for mounting the first retaining plate 103 to the mounting bracket, either by bolts or screws. The mounting bracket also comprises a foot portion 141, wherein the mounting bracket bends at a 90° angle, thereby enabling the foot to be directly or indirectly mounted to a support post by using post mounting holes 143 in the foot portion, and securing the mounting bracket to the support post 149 (or an intermediate mounting plate 145).

Figure 2:
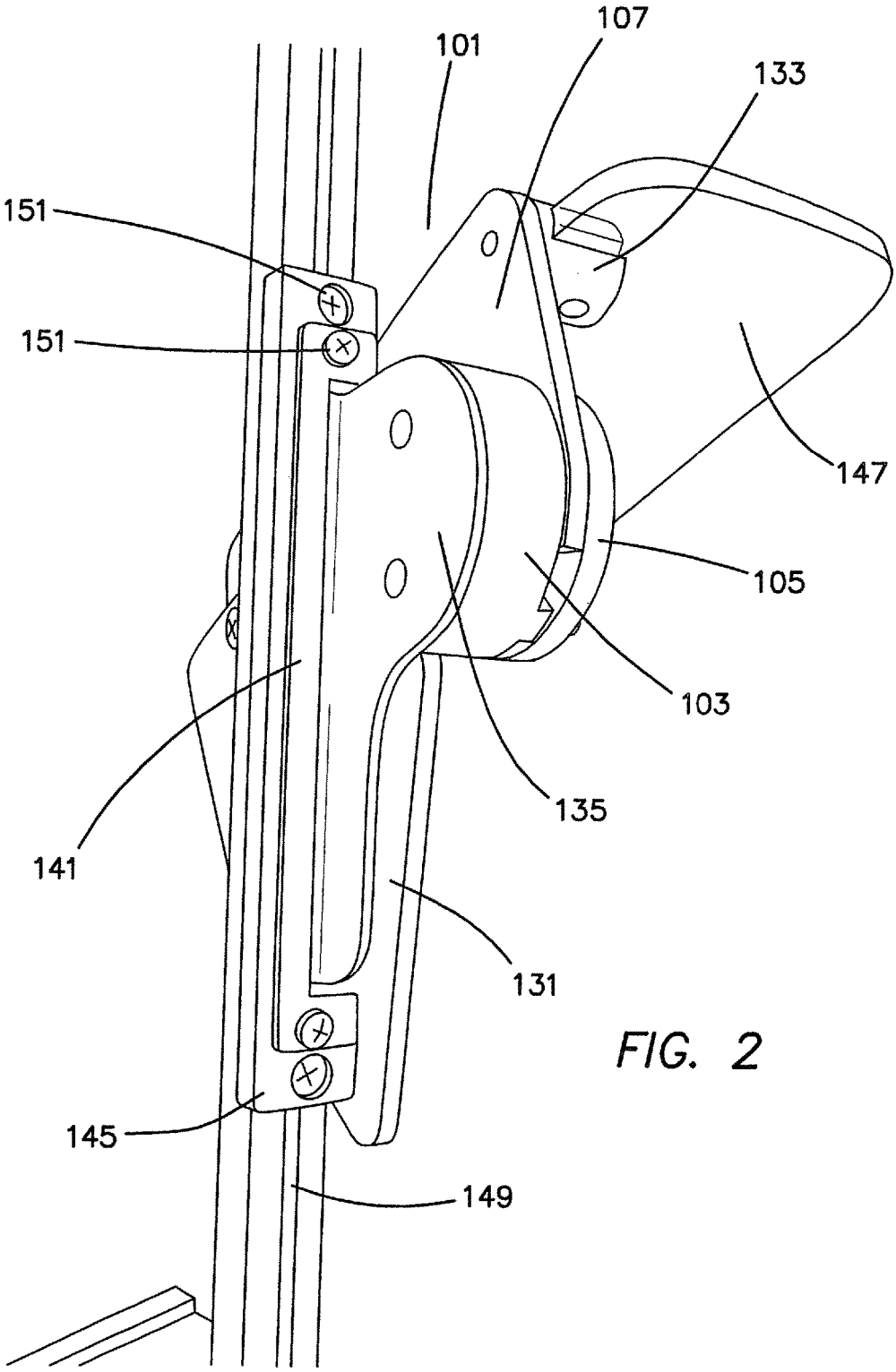

In FIG. 2 an adjustable hinge assembly 101 is shown indirectly mounted to a support post 149 using an intermediate mounting plate 145. The mounting plate 145 provides a larger flat surface area against which the foot portion 141 of the mounting bracket can be secured. In some embodiments the reverse side of the mounting plate 145 may be radiused to fit the curvature of a rounded support post 149, such as the one shown in FIG. 2, to provide a more secure fit. The mounting bracket 135 is mounted to the mounting plate 145 and the mounting plate is mounted to the support post 149 using mounting screws 151.

FIG. 2 also shows the adjustable hinge of FIG. 1 in an assembled state, with slotted pane fastening components 133 shown holding a sample pane of glass depicting the main sneeze guard pane 147 within the slots of a slotted pane fastening component 133 at any approximately horizontal angle (i.e., at about a 90° angle to the support post 149). Furthermore, the tuck-away wing 131 is also shown as mounted to the rotatable arm 107, which rotates between first retaining plate 103 and second retaining plate 105.

Figure 3:
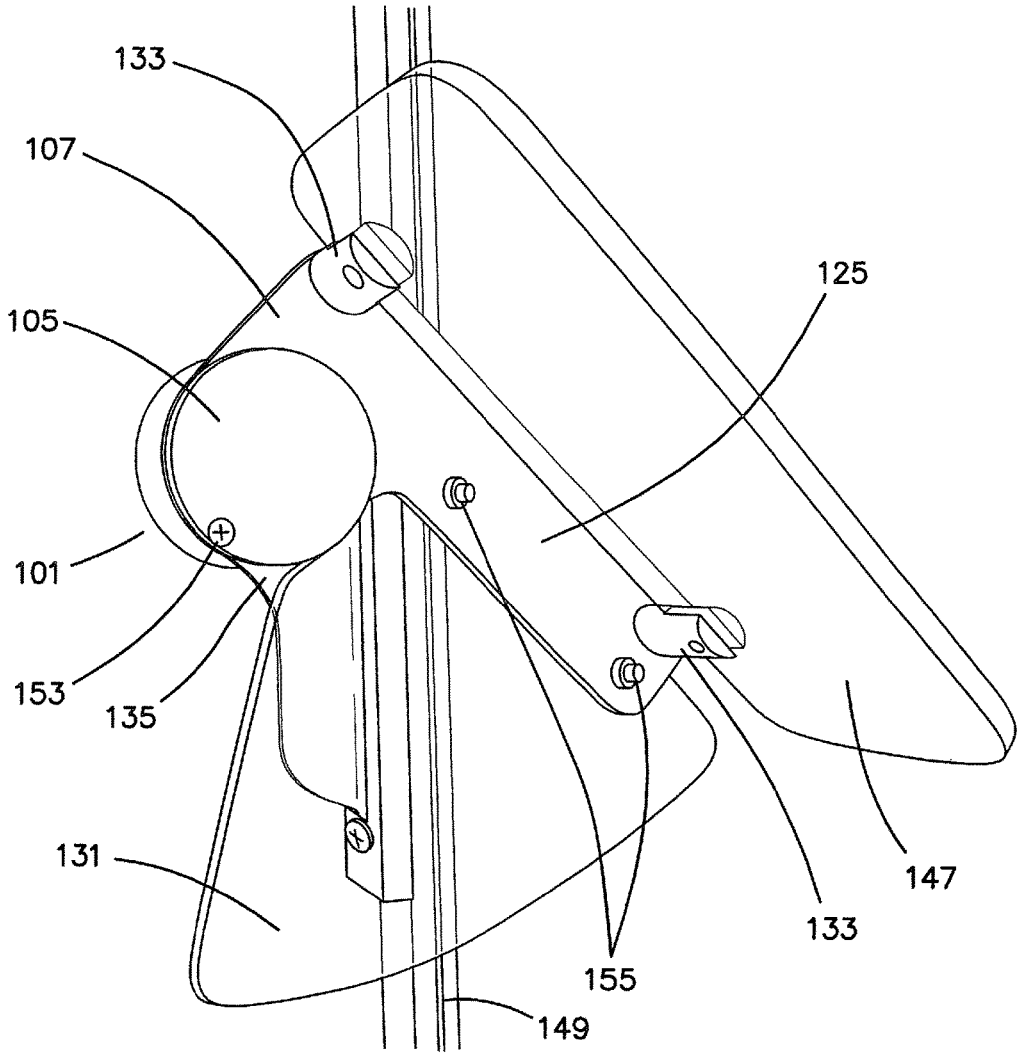

FIG. 3 shows the same adjustable hinge assembly 101 mounted on the support post 149 (as shown in FIG. 2), from the opposite side. Thus, the outer surface of second retaining plate 105 is clearly visible; adjustment screw 153 is inserted in a hole in the second retaining plate in order to be able to fine-tune the rotation of the rotatable arm 107.

In FIG. 3, two slotted fastening components 133 can be clearly seen gripping the main sneeze guard pane 147. It will be understood that any desired number of slotted fastening components 133 may be used; for example, in other embodiments a single elongated single slotted fastening component (preferably having at least two screw, rivet or bolt holes) would function adequately, and would be particularly useful if it is made to be long enough to prevent unwanted movement of the main sneeze guard pane 147. Also, the distal portion 125 of rotatable arm 107 is shown in FIG. 3 with bolts 155 connecting the tuck-away wing 131 to the rotatable arm through respective holes 129 and 127 (shown in FIG. 1).

Figure 4:
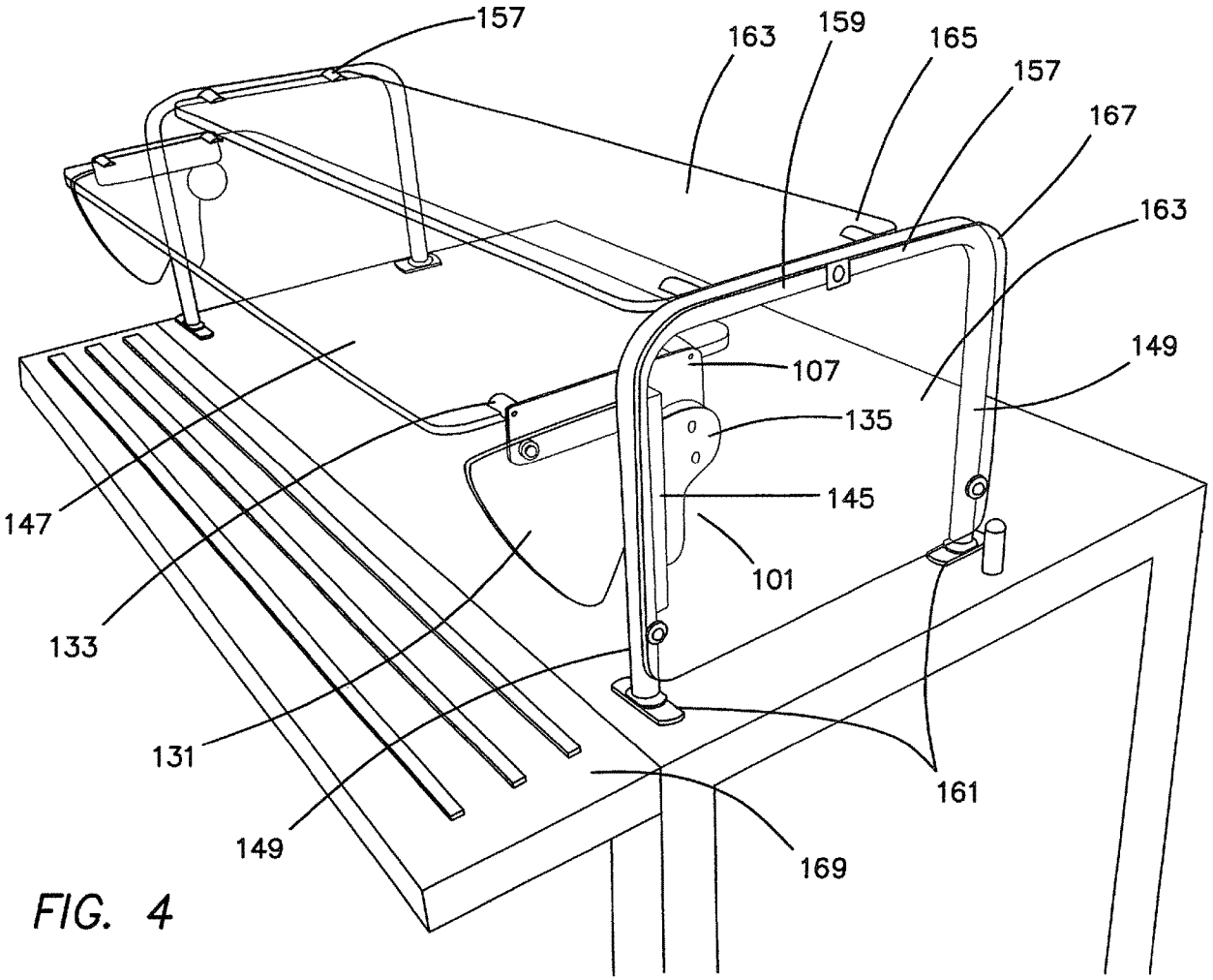

FIG. 4 is a view of a single-sided sneeze guard apparatus 101 and food service table of the present invention. Sneeze guard support frames 157, with each frame comprising a length of stainless steel tubing bent in an inverted U shape and having support posts 149 and a horizontal central span 159. Each support post is secured to the surface of the table using a foot apparatus 161 which is structured to be fastened to the top of the food service table 163 or other equipment.

As shown in FIG. 4, two sneeze guard support frames 157 are employed in this embodiment, and are positioned a sufficient distance apart to hold the main sneeze guard pane 147. Adjustable hinge assemblies 101 are affixed to support posts 149 on each sneeze support frame 157. Each adjustable hinge apparatus comprises a first retaining plate (shown in FIG. 3), a rotatable arm 107 containing slotted fastening components 133 and structured to hold both the main sneeze guard pane 147 and tuck-away wing 131, and the second retaining plate 135.

Additionally, the sneeze guard apparatus and food service table shown in FIG. 4 also comprises a horizontal upper pane 163 affixed to the horizontal central span 159 of the sneeze guard support frames 157. The horizontal upper pane may be secured and fastened to the support frame by any suitable method. Preferably, one or more slotted fastening components 165, similar or identical to the slotted fastening components 133 used to hold the main sneeze guard pane 147, are fastened to the horizontal central span 159 to hold horizontal upper pane firmly to the sneeze guard support frames 157.

The sneeze guard support frames 157 of FIG. 4 also comprise terminal frame panes 167 affixed to each sneeze guard support frames 157 to prevent infiltration of containments from either end of the food service table. Again, the terminal frame panes may be attached to the sneeze guard support frame (or only the support posts in other embodiments of the invention) by any suitable means; as shown the terminal frame panes are attached by screws to the outside of each sneeze guard support frame.

The food service table of FIG. 4 also comprises a lip component 169 so that plates or trays may be rested on the lip while food is served.

Figure 5:
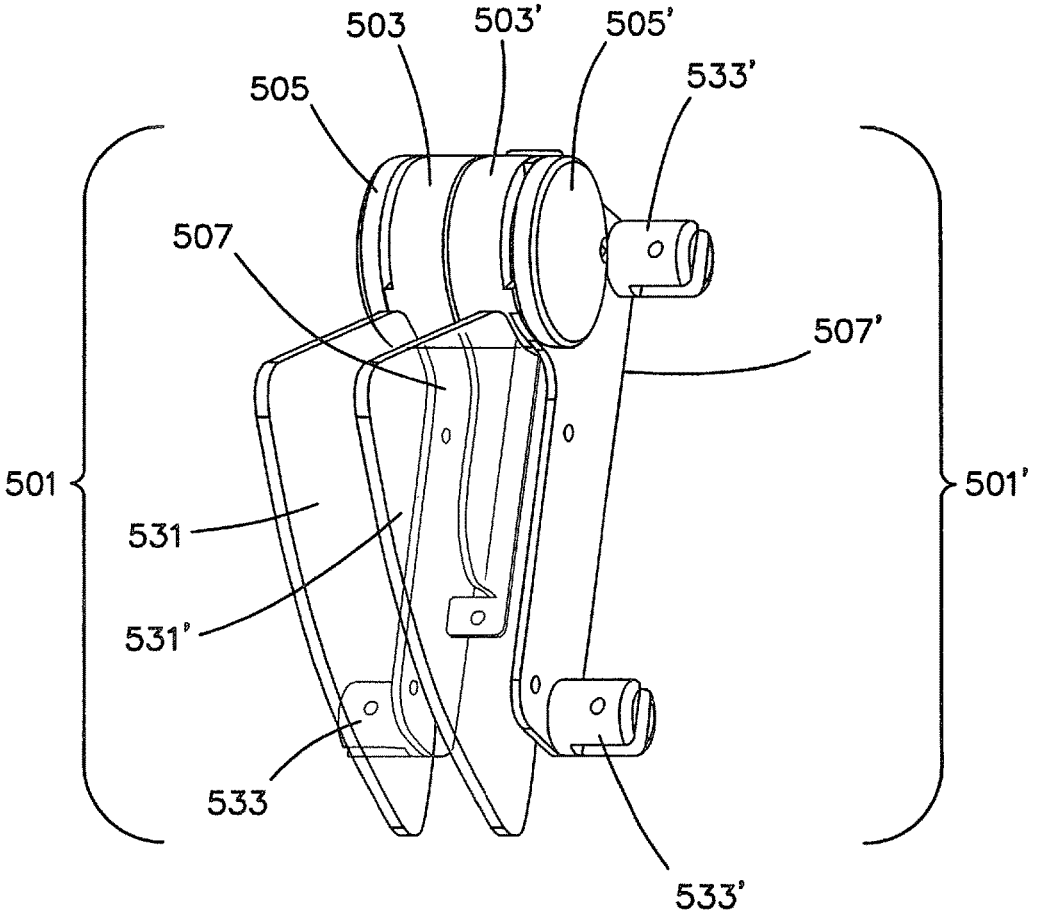

FIG. 5 shows a further embodiment of the invention comprising two joined adjustable hinges (501, 501'), in which the first retaining plates (503, 503') are screwed or bolted together back to back, and assembled as previously described, with rotatable arms 507, 507' and second retaining plates 507 and 507'.

As shown, the rotatable arms 507, 507' of the adjustable hinges are fitted with slotted fastening components 133, 133', structured to hold a main sneeze guard pane (not shown in FIG. 5).

Additionally, as shown in the embodiment depicted in FIG. 5, two "tuck-away" wings (531, 531') are affixed to the rotatable arms (507, 507') of the linked adjustable hinges (501, 501'); in other embodiments, involving both single and joined adjustable hinges, one or both tuck-away wings may be absent. When tuck-away wings are absent, the distal portions of the rotatable arm(s) (e.g. 507, 507') may be narrower in width and/or lack fasteners or holes structured to hold tuck-away wings.

Figure 6B:
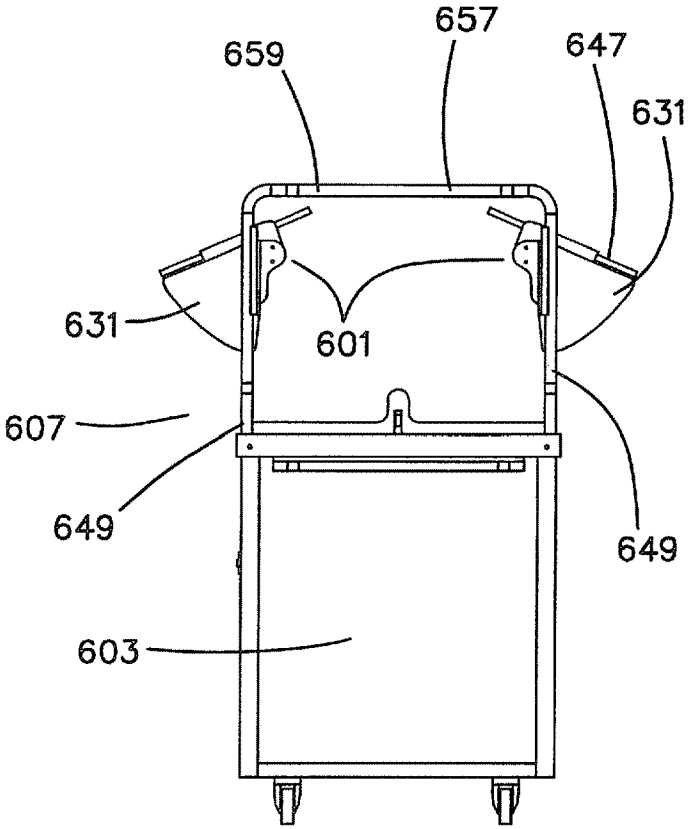
Figure 6A:
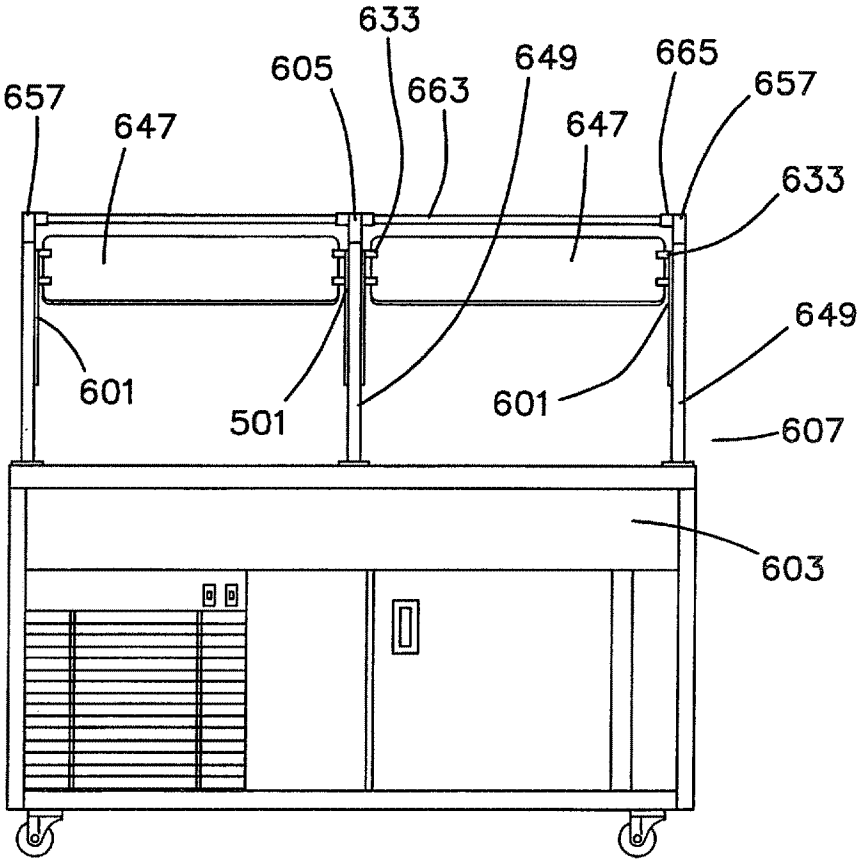

FIGS. 6A and 6B show front and side view, respectively, of a double-sided, double length sneeze guard apparatus 607 and food service table 603 of the present invention. In this embodiment each end of the sneeze guard apparatus comprises a sneeze guard support frames 657, and an intermediate support frame 605, with each support frame being structured substantially as set forth in FIG. 4, with support posts 649 and a horizontal centrals span 659. Between each pair of support frames a horizontal upper pane 663, is affixed to the horizontal central span 659 of each support frame by slotted fastening components 665.

Each of the sneeze guard support frames 657 located at the ends of the food service table 603 comprise one adjustable hinge 601 on each of the two support posts 649. Intermediate support frame 605 comprises joined adjustable hinges 501, as depicted in FIG. 5, mounted on each support post with one or more mounting brackets.

Main sneeze guard panes 647 are each joined to the rotatable arms of adjustable hinges 601 mounted on the intermediate support frame 605 and the sneeze guard support frames 657 located on the ends of the food service table 603 by slotted fastening components 633. Additionally, tuck away wings 631 are also mounted to the rotatable arms of the adjustable hinges (501, 601) as shown in FIGS. 1-4.

Figure 7:
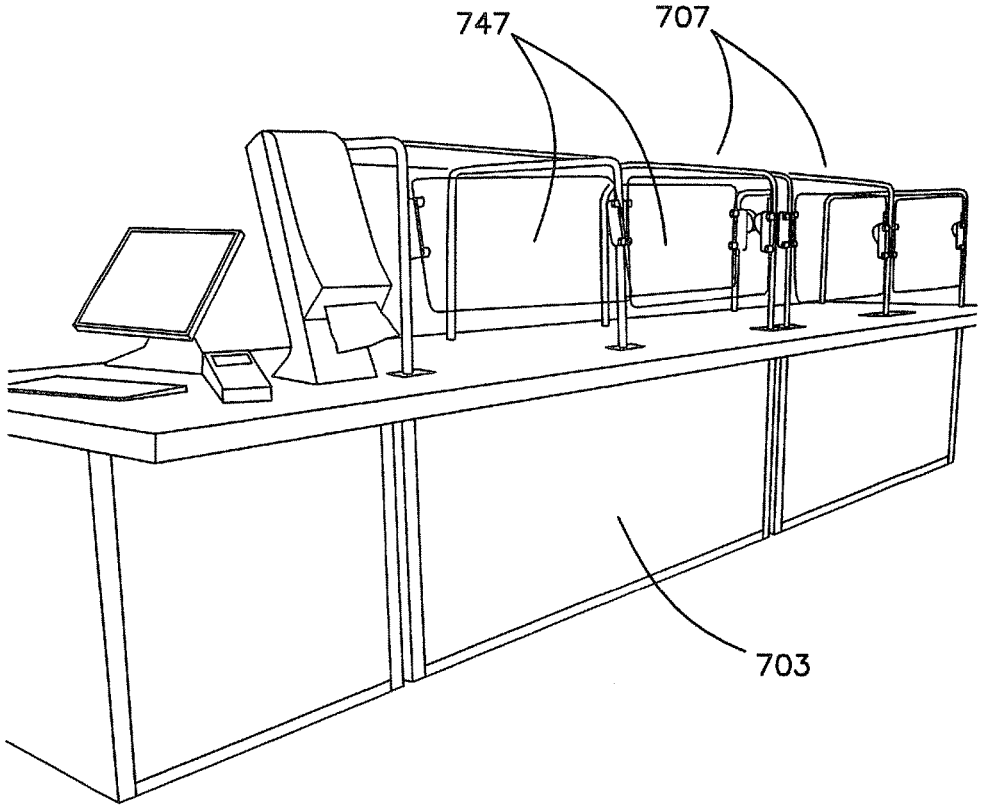

FIG. 7 shows an embodiment of the double-sided sneeze guard apparatus of the present invention, comprising two double-length apparatus 707 substantially as shown in FIG. 6 positioned in series on a single food service table 703, and having four independently adjustable main sneeze guard panes 747 on each side of the apparatus. Those of ordinary skill in the art are aware that the function of this embodiment may also be equivalently structured as a single apparatus comprising sneeze guard support frames positioned at each end of the apparatus and having single adjustable hinges on each support post thereof, and three intermediate support frames having joined, paired adjustable hinges mounted to each intermediate support post thereof.

Figure 8:
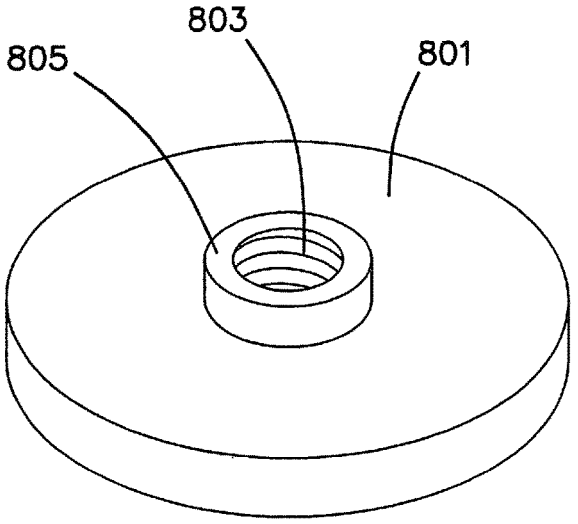

FIG. 8 shows the inside surface of an example of the second retaining plate, showing the tapped axial cavity 803. The ring-like shoulder 805 surrounds the axial cavity and serves as the axle around which the rotatable shoulder 107 rotates.

All patents, photographs, drawings and publications described in this specification are hereby incorporated herein by reference in their entirety.

To the extent that a plurality of inventions are disclosed herein, any such invention shall be understood to have disclosed herein alone, in combination with other features or inventions disclosed herein, or lacking any feature or features not explicitly disclosed as essential for that invention. For example, the inventions described in this specification can be practiced within elements of, or in combination with, other any features, elements, methods or structures described herein. Furthermore, each of said plurality of inventions is not to be construed as implicitly requiring elements or any other invention disclosed herein.

Additionally, features illustrated or disclosed herein as being present in one or more particular example are intended, in other examples of the present invention, to be explicitly lacking from the invention, or to be combinable with features described elsewhere in this patent application, in a manner not otherwise illustrated in this patent application or present in that particular example. The scope of the invention shall be determined solely by the language of the claims.

Thus, the various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive of other alternatives to the specific examples given, such that the present disclosure will be understood to provide a full written description of each of such alternatives as if each had been specifically described.

The invention claimed is:

1. An adjustable hinge apparatus comprising:

a) a first retaining plate component having an outer surface and an inner surface, said first retaining plate comprising an axial cavity and a plurality of ball pins protruding from the inner surface thereof, said ball pins being retained within respective ball pin holes formed in the first retaining plate component;

b) a rotatable arm component comprising a proximal portion and a distal portion extending away from the proximal portion, wherein said proximal portion comprises an axial hole and a plurality of detent holes formed at least partially around the axial hole;

c) a second retaining plate component having an outer surface and an inner surface, said inner surface comprising an axial cavity and a raised shoulder component circumferentially positioned around said axial cavity and structured to fit within the axial hole of the rotatable arm component; and d) a joining component affixed to the axial cavities of the first retaining plate component and the second retaining plate component, and extending through the axial hole of the rotatable arm component so as to retain the rotatable arm sandwiched between the first retaining plate component and the second retaining plate component and to retain the axial hole of the rotatable arm component positioned on the raised shoulder component of the second retaining plate component, wherein the ball pins of the first retaining plate and the detent holes are structured and arranged so as to engage and disengage when the rotatable arm is rotated about the raised shoulder component, and the rotatable arm is movably held in place by the ball pins relative to the first retaining plate when the ball pins engage with the detent holes.

2. The adjustable hinge of claim 1, wherein the distal portion of the rotatable arm comprises a fastening component.

3. The adjustable hinge of claim 2, wherein the fastening component comprises a plurality of holes defined in the distal portion of the rotatable arm.

4. The adjustable hinge of claim 1 wherein the plurality of ball pins comprises at least three, and the corresponding ball pin holes are arranged in an equilateral polygonal distribution around the axial cavity on the inner surface of the first retaining plate.

5. The adjustable hinge of claim 4 wherein the axial cavity of at least one of the first retaining plate and the second retaining plate is tapped to contain threads, and the joining component comprises a retaining screw having threads complementary to those of said axial cavity.

6. The adjustable hinge of claim 5 containing no structure restricting rotation of the rotatable arm between 0° and 360° about the raised shoulder of the second retaining plate.

7. The adjustable hinge of claim 5 containing a structure restricting rotation of the rotatable arm between 0° and 360° about the raised shoulder of the second retaining plate.

8. A sneeze guard assembly comprising:

a) two vertically extending support posts, each comprising features for affixing the support post to a horizontal surface and lacking an integral attachment fixture for mounting one or more hinge;

b) a main sneeze guard pane having a thickness and two lateral ends;

c) a hinge joining each end of the main sneeze guard to one of the support posts with at least one such hinge comprising an adjustable hinge including:

i) a first retaining plate component having an outer surface and an inner surface, said first retaining plate comprising an axial cavity and a plurality of ball pins protruding from the inner surface thereof, said ball pins being retained within respective ball pin holes formed in the first retaining plate component;

ii) a rotatatable arm component comprising a proximal portion and a distal portion extending away from the proximal portion, wherein the proximal portion comprises an axial hole and a plurality of detent holes formed at least partially around the axial hole and the distal portion comprises a fastening component joined to an end of the main sneeze guard pane;

iii) a second retaining plate component having an outer surface and an inner surface, said inner surface comprising an axial cavity and a raised shoulder component circumferentially positioned around said axial cavity and structured to fit within the axial hole of the rotatable arm component;

iv) a joining component affixed to the axial cavities of the first retaining plate component and the second retaining plate component, and extending through the axial hole of the rotatable arm component so as to retain the rotatable arm sandwiched between the first retaining plate component and the second retaining plate component, and to retain the axial hole of the rotatable arm component positioned on the raised shoulder component of the second retaining plate component;

wherein the ball pins of the first retaining plate and the detent holes are structured and arranged so as to engage and disengage as the rotatable arm is rotated about the raised shoulder component, and the rotatable arm is movably held in place by the ball pins relative to the first retaining plate when the ball pins engage with the detent holes.

9. The sneeze guard of claim 8 wherein the support posts are part of separate, inverted U-shaped, support frames; and wherein a horizontal pane is mounted on a horizontally extending portion of each support frame, thereby connecting the support frames.

10. The sneeze guard of claim 9 wherein both said hinges comprise said adjustable hinge.

11. The sneeze guard of claim 10 wherein said first retaining plate is directly or indirectly mounted on said support post by a plurality of screws or bolts.

12. The sneeze guard of claim 11 wherein said first retaining plate is directly mounted to a mounting bracket having a foot portion, said mounting bracket having a plurality of hinge mounting holes, and said mounting bracket is directly or indirectly mounted to said support post by a plurality of screws or bolts.

13. The sneeze guard of claim 12 wherein said mounting bracket is directly mounted to said support post by a plurality of screws or bolts.

14. The sneeze guard of claim 12 wherein said mounting bracket is directly mounted on an intermediate mounting plate, said intermediate mounting plate being directly mounted to said support post by a plurality of screws or bolts.

15. The sneeze guard of claim 9 comprising:

an additional support frame containing a hinge joining one end of an additional main sneeze guard pane having lateral ends thereto, wherein at least one of said support frames is a vertically extending intermediate support frame having a support post affixed to two adjustable hinges firmly joined back-to-back or front-to-back;

wherein an end of the main sneeze glass pane is joined to the distal end of the rotatable arm of one said adjustable hinges, and the other end of the additional main sneeze glass pane is joined to the distal end of the rotatable arm of the adjustable hinges of said joined adjustable hinges so that the main sneeze guard pane and the additional sneeze guard pane are aligned substantially from back to front, and wherein the angle of the main sneeze guard pane and the angle of the additional main sneeze guard pane may be independently adjusted.

16. A food service table having said horizontal surface, two ends and two sides, and a sneeze guard assembly of claim 9 along each side thereof.

17. A food service table having said horizontal surface, two ends and two sides, and a sneeze guard assembly of claim 15 along each side thereof.

18. A sneeze guard assembly compromising a) two vertically extending support posts, each comprising features for affixing the support post to a horizontal surface and lacking an integral molded attachment fixture for mounting one or more hinge;

b) a main sneeze guard pane having a thickness and two lateral ends;

c) an adjustable hinge joining each end of the main sneeze guard to one of the support posts, said adjustable hinge including:

i) a first retaining plate component having an outer surface and an inner surface, said first retaining plate comprising an axial cavity and a plurality of ball pins protruding from the inner surface thereof, said ball pins being retained within respective ball pin holes formed in the first retaining plate component, ii) a rotatable arm component comprising a proximal portion and a distal portion extending away from the proximal portion, wherein the proximal portion comprises an axial hole and a plurality of detent holes formed at least partially around the axial hole and the distal portion comprises a) a first fastening component joined to an end of the main sneeze guard pane, and b) an optional second fastening component joined to a tuck-away wing pane, said wing pane having a surface plane aligned with the axis of rotation of said rotatable arm about 90° to an axis of the main sneeze guard pane, iii) a second retaining plate component having an outer surface and an inner surface, said inner surface comprising an axial cavity and a raised shoulder component circumferentially positioned around said axial cavity and structured to fit within the axial hole of the rotatable arm component;

iv) a joining component affixed to the axial cavities of the first retaining plate component and the second retaining plate component, and extending through the axial hole of the rotatable arm component so as to retain the rotatable arm sandwiched between the first retaining plate component and the second retaining plate component, and to retain the axial hole of the rotatable arm component positioned on the raised shoulder component of the second retaining plate component, wherein the ball pins of the first retaining plate and the detent holes are structured and arranged so as to engage and disengage as the distal end of the rotatable arm is rotated about the raised shoulder component, and the rotatable arm is movably held in place by the ball pins relative to the first retaining plate when the ball pins engage with the detent holes, and wherein each of the rotatable arms of the adjustable hinges independently optionally comprises said second fastening component joined to a tuck-away wing pane.

19. The sneeze guard assembly of claim 18 wherein all the rotatable arms of each of the adjustable hinges comprises said second fastening component joined to a tuck-away wing pane.

* * * * *